US005870129A

United States Patent [19]

Ikegawa et al.

[11] Patent Number: 5,870,129

[45] Date of Patent: Feb. 9, 1999

[54] IMAGE FORMING METHOD AND APPARATUS TRANSFERRING AN INK IMAGE

[75] Inventors: Akihito Ikegawa, Osaka; Hiroyuki Yamasaki, Amagasaki, both of Japan

[73] Assignee: Minolta Co., Ltd., Osaka, Japan

[21] Appl. No.: 713,503

[22] Filed: Sep. 13, 1996

[30] Foreign Application Priority Data

| | | | |
|---|---|---|---|
| Sep. 14, 1995 | [JP] | Japan | 7-236323 |
| Mar. 7, 1996 | [JP] | Japan | 8-080625 |
| Mar. 7, 1996 | [JP] | Japan | 8-080626 |
| Mar. 7, 1996 | [JP] | Japan | 8-080627 |
| Mar. 7, 1996 | [JP] | Japan | 8-080628 |
| Mar. 7, 1996 | [JP] | Japan | 8-080629 |
| Jul. 3, 1996 | [JP] | Japan | 8-173321 |

[51] Int. Cl.[6] ..... B41J 2/385; G03G 15/00; G03G 9/08

[52] U.S. Cl. ..... 347/155

[58] Field of Search ..... 399/130, 147, 399/237, 135, 296; 347/155, 120, 102, 105, 221, 112, 149, 139, 140, 129; 430/117, 112, 126, 124

[56] References Cited

U.S. PATENT DOCUMENTS

| | | | |
|---|---|---|---|
| 3,811,765 | 5/1974 | Blake | 399/135 |
| 4,047,943 | 9/1977 | Lu | 430/118 |
| 4,272,599 | 6/1981 | Moradzadeh | 430/100 |
| 4,393,390 | 7/1983 | Aoki et al. | 347/149 |
| 5,459,008 | 10/1995 | Chambers et al. | 399/296 |
| 5,635,971 | 6/1997 | Aono et al. | 347/112 |

FOREIGN PATENT DOCUMENTS

| | | |
|---|---|---|
| 7-271107 | 10/1995 | Japan . |
| 7-271198 | 10/1995 | Japan . |

*Primary Examiner*—N. Le
*Assistant Examiner*—L. Anderson
*Attorney, Agent, or Firm*—Burns, Doane, Swecker & Mathis, LLP

[57] ABSTRACT

An image forming method according to the present invention comprises the steps of forming an electrostatic latent image on an image carrying member by a latent image forming device, applying a release agent to the surface of the image carrying member by an application device, and bringing an ink carried on an ink carrying member into contact with the surface of the image carrying member coated with the release agent to form an ink image corresponding to the electrostatic latent image on the surface of the image carrying member.

24 Claims, 4 Drawing Sheets

IMAGE FORMING METHOD AND APPARATUS TRANSFERRING AN INK IMAGE

BACKGROUND OF THE INVENTION

1. Field of the Invention

The present invention relates to an image forming method and an image forming apparatus in which an electrostatic latent image is formed on an image carrying member, and the electrostatic latent image is developed using an ink, to form an image.

2. Description of the Related Art

As are represented by electrophotographic copying machines, image forming apparatuses so adapted as to form an electrostatic latent image on the surface of an image carrying member, develop the electrostatic latent image with toner particles to form a toner image, and then transfer the toner image on a recording medium such as paper to form an image on the recording medium have been conventionally used. One of the electrophotographic image forming apparatuses, an image forming apparatus using a liquid developer constructed by dispersing colored resin particles (toner particles) in a carrier liquid in order to develop the electrostatic latent image has been known.

The electrophotographic image forming apparatus using the liquid developer has advantages that the resolution thereof is superior, for example, while having disadvantages that an image having a sufficient image density is not obtained on a recording medium, and an image formed on the recording medium is fogged because toner adheres to an image carrying member even in a portion where no electrostatic latent image is formed and is transferred to the recording medium.

SUMMARY OF THE INVENTION

An object of the present invention is to provide a new and useful image forming method and image forming apparatus in which the above-mentioned disadvantages are overcome.

Another object of the present invention is to provide an image forming method and an image forming apparatus in which a good image which is not fogged can be formed.

Still another object of the present invention is to provide an image forming method and an image forming apparatus in which a good image having no voids can be formed.

Still another object of the present invention is to provide an image forming method and an image forming apparatus in which a good image having a sufficient image density can be formed.

A further object of the present invention is to provide an image forming method and an image forming apparatus in which a good image having a high contrast can be formed.

A still further object of the present invention is to provide an image forming method and an image forming apparatus in which a good image can be formed in simple construction.

A still further object of the present invention is to provide an image forming method and an image forming apparatus in which a good image can be formed over a long time period.

In order to attain the above-mentioned objects, an image forming method according to the present invention is characterized by comprising the steps of forming an electrostatic latent image on an image carrying member, applying a release agent to the surface of the image carrying member, and bringing an ink into contact with the surface of the image carrying member coated with the release agent to form an ink image corresponding to the electrostatic latent image on the surface of the image carrying member.

Furthermore, in order to attain the above-mentioned objects, an image forming apparatus according to the present invention is characterized by comprising an image carrying member, a latent image forming device for forming an electrostatic latent image on the surface of the image carrying member, an application device for applying a release agent to the surface of the image carrying member, and an ink carrying member having an ink layer having a predetermined thickness carried on its surface and bringing the ink layer into contact with the surface of the image carrying member coated with the release agent to form an ink image corresponding to the electrostatic latent image on the surface of the image carrying member.

Additionally, in order to attain the above-mentioned objects, an image forming apparatus according to the present invention is characterized by comprising an image carrying member having a dielectric layer, a plurality of stylus electrodes for forming an electrostatic latent image on the surface of the image carrying member, an application device for applying a release agent to the surface of the image carrying member, an ink carrying member having an ink having a predetermined thickness carried on its surface and bringing the ink into contact with the surface of the image carrying member coated with the release agent to form an ink image corresponding to the electrostatic latent image on the surface of the image carrying member, and an image transfer device for transferring the ink image formed on the surface of the image carrying member to a recording medium.

These and other objects, advantages and features of the invention will become apparent from the following description thereof taken in conjunction with the accompanying drawings which illustrate specific embodiments of the invention.

BRIEF DESCRIPTION OF THE DRAWINGS

In the following description, like parts are designated by like reference numbers throughout the several drawings.

DESCRIPTION OF THE PREFERRED EMBODIMENTS

Figure 1A:
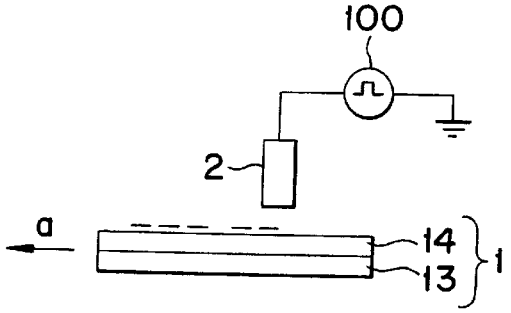
FIGS. 1(A) to 1(D) show the steps in an image forming process according to the present invention.
Figure 1B:
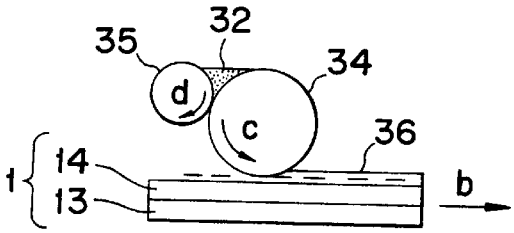
Figure 1C:
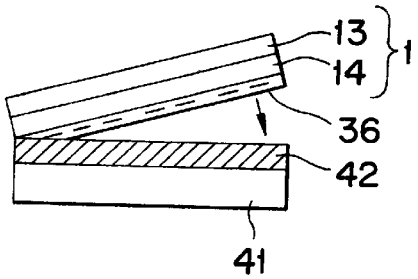
Figure 1D:
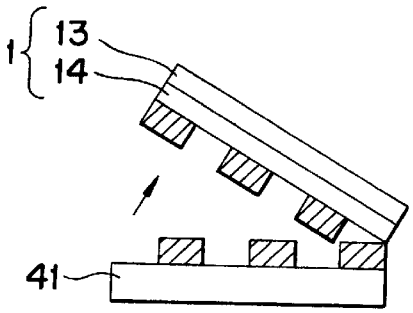

Specific embodiments of an image forming method and an image forming apparatus according to the present invention will be described.

In embodying the present invention, at least the steps of forming an electrostatic latent image on an image carrying member, applying a release agent to the surface of the image carrying member, and bringing an ink into contact with the surface of the image carrying member coated with the release agent to form an ink image corresponding to the electrostatic latent image on the surface of the image carrying member are carried out.

When an ink carried on an ink carrying member is brought into contact with the surface of the image carrying member coated with the release agent, the ink is not supplied to a portion where no electrostatic latent image is formed of the image carrying member, while being supplied to only a portion where the electrostatic latent image is formed.

As the release agent, it is possible to use various types of release agents. A release agent having a high resistivity is preferable in order not to disturb the electrostatic latent image formed on the surface of the image carrying member, which is not particularly limited. In addition thereto, a silicone oil is preferable from the viewpoint of convenience for handling.

The image carrying member is not particularly limited, provided that a dielectric layer is formed on an electrically conductive member. It is possible to use image carrying members in various forms. Further, the shape thereof is not particularly limited. For example, the shape may be a drum shape or a film shape.

Examples of a material composing the electrically conductive member in the image carrying member include metals such as aluminum, iron, copper, nickel, SUS, gold, silver, chromium, platinum, tin, and titanium, alloys of the metals, and resins having any of the conductive materials dispersed therein. In dispersing any one the electrically conductive materials in the resin, it is possible to use, as the resin, polyethylene, polypropylene, polyvinyl alcohol, polyvinyl acetate, an ethylene-vinyl acetate copolymer, polymethyl methacrylate, polycarbonate, polystyrene, an acrylonitrile-methyl acrylate copolymer, an acrylonitrile-butadiene-styrene copolymer, polyethylene terephthalate, polyurethane elastomer, polyamide, polyimide, etc.

Examples of a material composing the dielectric layer formed on the electrically conductive member include resins such as polyester, polypropylene, polyvinyl alcohol, polyvinyl acetate, an ethylene-vinyl acetate copolymer, polymethyl methacrylate, polycarbonate, polystyrene, an acrylonitrile-methyl acrylate copolymer, an acrylonitrile-butadiene-styrene copolymer, polyethylene terephthalate, polyurethane elastomer, viscose rayon, cellulose nitrate, cellulose acetate, cellulose triacetate, cellulose propionate, cellulose acetate butyrate, ethyl cellulose, regenerated cellulose, polyamide (nylon 6, nylon 66, nylon 11, nylon 12, nylon 46, etc.), polyimide, polysulfone, polyether sulfone, polyvinyl chloride, a vinyl chloridevinyl acetate copolymer, polyvinylidene chloride, a vinylidene chloride-vinyl chloride copolymer, vinyl nitrile rubber, polytetrafluoroethylene, polychlorofluoroetylene, polyvinyl fluoride, and polyvinylidene fluoride, and inorganic materials composed of ceramics such as $A1_2O_3$, $SiO_2$ and $TiO_2$. It is also possible to use a combination of two or more dielectric materials.

As the ink, it is possible to use inks composed of a colorant, a vehicle, and an additive added as required, which are represented by inks for printing, for example. It is preferable to use an ink used for planographic printing out of the inks for printing. An oily ink is particularly preferable.

As the colorant, it is possible to use various types of colorants conventionally known such as pigments. Examples of black pigments include carbon black. Examples of yellow pigments include yellow iron oxide. Examples of red pigments include lake red C, brilliant carmine 6B, rhodamine 6GPTMA toner, and red iron oxide. Examples of blue pigments include prussian blue and cobalt blue.

As the vehicle, an oil, a resin, a solvent, a plasticizer, etc. are used. Preferred examples of the oil used as the vehicle include vegetable oils such as linseed oil and china wood oil. In addition thereto, treated oils, mineral oils, etc. may be used. Examples of the resin used as the vehicle include synthetic resins such as phenol resin modified by rosin, natural resins such as gilsonite, and natural resin derivatives. Preferred examples of the solvent used as the vehicle include high-boiling petroleum solvents such as tetradecane and pentadecane. Examples of the plasticizer added as required to the vehicle include esters such as adipic acid ester or sebacic acid ester, and paraffin chloride.

Examples of the additive added as required to the ink include waxes such as vegetable waxes, animal waxes, mineral waxes, and synthetic waxes, dryers such as metal soap and organic acids, surface-active agents such as lecithin and sorbitan fatty acid ester, and gelling agents such as hydrogenated castor oil and aluminum soap.

It is preferable that the viscosity of the ink is high. Specifically, it is preferable to use inks having viscosities of approximately 10,000 to 1,000,000 cp. Further, it is more preferable in terms of prevention of fogging to use inks having viscosities of 100,000 to 400,000 cp.

Furthermore, it is preferable that the resistivity of an ink is high. Specifically, it is preferable that the volume resistivity thereof is not less than $1\times10^8$ Ω. cm. Although the upper limit of the volume resistivity is not particularly limited, a volume resistivity of approximately $1\times10^{16}$ Ω. cm is sufficient.

It is preferable that the density of a solid content included in the ink is approximately 30 to 50% by weight per the entire weight of the ink.

Furthermore, in applying the release agent to the surface of the image carrying member having the electrostatic latent image formed thereon, if the amount of application of the release agent to the surface of the image carrying member is too small, the ink is supplied even to a portion where no electrostatic latent image is formed of the image carrying member in a case where the ink is brought into contact with the surface of the image carrying member, whereby the formed image may be fogged. On the contrary, if the amount of application of the release agent is too large, the ink is not satisfactorily supplied to a portion where the electrostatic latent image is formed of the image carrying member, whereby the formed image may not be suitable because the density thereof is decreased. Therefore, in applying the release agent to the surface of the image carrying member, it is preferable that the release agent is applied to the surface of the image carrying member so that the thickness thereof is in the range of 0.1 to 10 $\mu$m.

Embodiments of the present invention will be described in more detail using the drawings.

EMBODIMENT 1

FIG. 1 is a diagram for explaining image forming processes which are one embodiment of an image forming method according to the present invention. In FIG. 1(*a*), an image carrying member 1 is so constructed that a dielectric layer 14 is formed on a conductive base substrate 13. A discharge electrode 2 is composed of an electrically conductive member having its end formed in a needle shape or a brush shape. A voltage is applied to the discharge electrode 2 in response to an image signal by voltage applying means 100. When the voltage is applied to the discharge electrode 2, charge is stored on the surface of the dielectric layer 14. At this time, an electrostatic latent image is successively formed on the dielectric layer 14 by modulating an output of the voltage applying means 100 in conformity with image information while moving the image carrying member 1 in a direction indicated by an arrow a (a first step).

In FIG. 1(*b*), the electrostatic latent image is formed subsequently to the first step, after which an application roller 34 for applying a release agent 32 which is provided opposite to the image carrying member 1 is rotated in a direction indicated by an arrow c while moving the image carrying member 1 in a direction indicated by an arrow b, and a regulating roller 35 opposite to the application roller 34 is further rotated in a direction indicated by an arrow d, whereby the release agent 32 flows uniformly little by little from a nip portion between the application roller 34 and the regulating roller 35. The release agent 32 is supplied along the periphery of the application roller 34, and is uniformly applied thin to the surface of the dielectric layer 14. As a result, a thin film layer 36 of the release agent 32 is successively formed on the surface of the dielectric layer 14 (a second step).

In FIG. 1(*c*), the image carrying member 1 having the thin film layer 36 of the release agent 32 formed on its surface and an ink carrying member 41 having an ink layer 42 previously formed on its surface are made to closely adhere to each other subsequently to the second step. In FIG. 1(*d*), the image carrying member 1 is stripped from the ink carrying member 41 (a third step).

At this time, in a portion where no electrostatic latent image is formed of the dielectric layer 14 in the image carrying member 1, the thin film layer 36 exits between the ink layer 42 and the dielectric layer 14, whereby the ink does not adhere to the image carrying member 1. On the other hand, in a portion where the electrostatic latent image is formed of the dielectric layer 14, the ink is drawn by the dielectric layer 14 upon exertion of an electrostatic force, to adhere on the image carrying member 1. As a result, the ink selectively adheres to only the portion where the electrostatic latent image is formed, whereby the electrostatic latent image is developed without causing fogging.

The developed image on the image carrying member 1 can be transferred to a recording medium such as paper by the contact or the application of pressure using a roller or the like. In this case, the thin film layer 36 is interposed between the image carrying member 1 and the ink, whereby the ink is easily separated from the image carrying member 1, and is transferred to the recording medium.

The order of the above-mentioned first and second steps may be reversed. Even when the electrostatic latent image is written after the release agent is applied, it is possible to obtain a good image which is prevented from being fogged, for example, in the same manner as described above.

Description is now made of a specific experimental example of EMBODIMENT 1.

EXPERIMENTAL EXAMPLE 1

An image carrying member so adapted that aluminum is deposited over a polyethylene terephtalate (PET) film having a thickness of 25 μm is used as the image carrying member 1. In addition, a conductive brush member having its end formed in a brush shape is used as the discharge electrode 2. A voltage of −1.2 kV is applied to the conductive brush member in response to an image signal, to move the PET film in the direction indicated by the arrow a in FIG. 1, to form an electrostatic latent image having a surface potential of approximately −800 V. Further, Silicone Oil SH 200 (manufactured by Toray Dow Coning Silicone Co., Ltd.) which is a silicone oil having a viscosity of approximately 291 cp is used as the release agent 32. The Silicone Oil SH 200 is applied to the PET film to various thicknesses shown in the following Table 1 by the application roller 34.

On the other hand, an ink carrying member having an ink layer formed by applying BSD New Rubber Base (manufactured by Bunshodo K.K.) which is an ink for planographic printing is separately prepared as the ink carrying member 1, and the above-mentioned PET film is made to closely adhere to the ink layer, after which the PET film is stripped.

An ink image is transferred to the paper upon bringing the paper into contact with the PET film, and image densities in an image portion (a portion which corresponds to the electrostatic latent image formed on the film) and a a non-image portion (a portion which does not correspond to the electrostatic latent image formed on the film) of the paper are detected as reflection densities by Sakura Densitometer PD65 (manufactured by Konica Co., Ltd.).

Table 1 shows, in a case where the thickness of the silicone oil is changed in the range of 0.01 to 20 μm to form an image in the above-mentioned image forming processes, the results of measurements of image densities in the non-image portion and the image portion of the paper on which the image is transferred. In Table 1, "contrast" is defined by the difference in image density between the non-image potion and the image portion. A case where a good image having a contrast of not less than 0.8 and having an image density of less than 0.3 in its non-image portion is obtained is evaluated as ○, a case where an image having a contrast of not less than 0.45 and less than 0.8 and having an image density of less than 0.5 in its non-image portion or an image having a contrast of not less than 0.8 and having an image density of not less than 0.3 and less than 0.5 in its non-image portion, which has no problems in terms of practical applications, is obtained is evaluated as Δ, and a case where an image having a contrast of less than 0.45 or an image having an image density of not less than 0.5 in its non-image portion, which has problems, is obtained is evaluated as x.

In a case where the same processes are carried out without applying the silicone oil, the ink adheres to both the portion which corresponds to the electrostatic latent image and the portion which does not correspond to the electrostatic latent image, whereby no image can be formed.

TABLE 1

| thickness of silicone oil (μm) | 0.01 | 0.1 | 0.5 | 1 | 3 | 5 | 8 | 10 | 12 | 15 | 20 |
|---|---|---|---|---|---|---|---|---|---|---|---|
| density in non-image portion | 2.1 | 0.47 | 0.28 | 0.1 | 0.05 | 0.03 | 0.02 | 0.02 | 0.02 | 0.02 | 0.02 |

TABLE 1-continued

| | | | | | | | | | | | |
|---|---|---|---|---|---|---|---|---|---|---|---|
| density in image portion | 2.2 | 2.1 | 2.1 | 2.1 | 1.8 | 1.2 | 0.6 | 0.47 | 0.35 | 0.2 | 0.1 |
| contrast | 0.1 | 1.6 | 1.8 | 2.0 | 1.75 | 1.17 | 0.58 | 0.45 | 0.33 | 0.18 | 0.08 |
| evaluation | x | Δ | ○ | ○ | ○ | ○ | Δ | Δ | x | x | x |

EMBODIMENT 2

Figure 2:
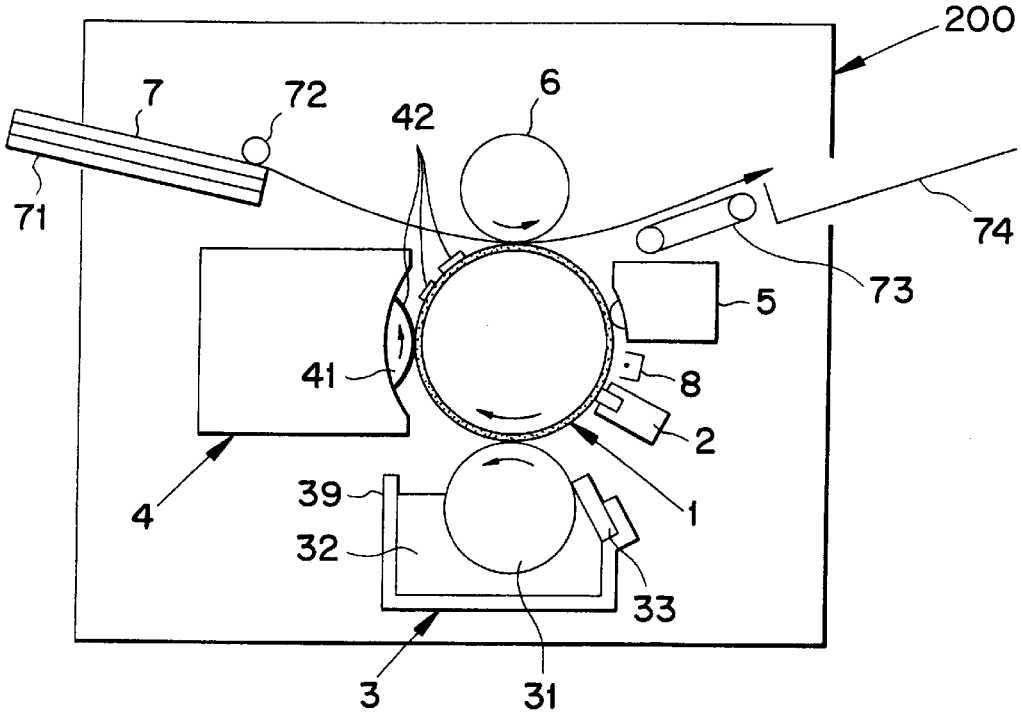
FIG. 2 is a schematic view showing an image forming apparatus according to one embodiment of the present invention.

FIG. 2 is a schematic cross-sectional view showing an image forming apparatus 200 according to one embodiment of the present invention. As shown in FIG. 2, in the image forming apparatus 200, an image carrying member 1 so adapted that a dielectric layer is formed on the surface of an electrically conductive member in a cylindrical shape is used, and a discharge electrode 2 formed in a multi stylus shape is used as latent image forming means for forming an electrostatic latent image on the surface of the image carrying member 1.

The latent image forming means for forming an electrostatic latent image on the surface of an image carrying member is not limited to the foregoing, provided that the electrostatic latent image can be formed by selectively charging the surface of the image carrying member. It is possible to use various types of means. For example, electrostatic latent image forming means of an ion flow type so adapted as to expose a transparent photosensitive member by exposing means and induce discharges from the transparent photosensitive member may be used.

In forming the electrostatic latent image on the image carrying member by the latent image forming means, when the surface potential of the electrostatic latent image is low, an ink is not sufficiently supplied, whereby an image having a sufficient image density may not be obtained. On the contrary, if the surface potential of the electrostatic latent image is too high, voids or the like may be created on a formed image. Therefore, it is preferable that the absolute value of the surface potential in a portion where the electrostatic latent image is formed is in the range of 200 to 2000 V.

Image formation is possible even if an electrophotographic photoreceptor is used as the image carrying member 1, the surface of the image carrying member 1 is exposed using known methods such as an optical scanner and a laser scanner after being uniformly charged by a corona discharger or the like to form a charge distribution on the surface of the image carrying member 1 so that an electrostatic latent image is formed thereon.

An application device 3 for applying a release agent is provided below the image carrying member 1. A release agent 32 such as a silicone oil is applied to the surface of the image carrying member 1 having the electrostatic latent image formed thereon by the application device 3. The application device 3 comprises a container 39 storing the release agent 32, an application roller 31 opposite to a lower part of the image carrying member 1 and having its lower part dipped in the release agent 32, and a regulating blade 33 for regulating the amount of the release agent carried on the application roller 31. The application roller 31 is rotated, and the amount of the release agent 32 is regulated by the regulating blade 33, to adjust the thickness of the release agent 32 on the surface of the application roller 31, and the release agent 32 is applied to the surface of the image carrying member 1 having the electrostatic latent image formed thereon from the application roller 31. Applying means for applying the release agent is not also limited to that in the present embodiment. It is possible to use applying means in various forms.

An ink developing device 4 is provided beside the image carrying member 1. The ink developing device 4 comprises an ink carrying member 41, and an ink storage tank and a regulating blade which are not illustrated. In forming an ink image on the surface of the image carrying member 1, the ink carrying member 41 is rotated, to form a thin layer of an ink 42 on the ink carrying member 41, and the ink 42 carried on the ink carrying member 41 is brought into contact with the surface of the image carrying member 1 coated with the release agent 32, to supply the ink 42 to the image carrying member 1. Means for forming the thin layer of the ink 42 on the ink carrying member 41 is not limited to that in the present embodiment. It is possible to use means in various forms.

Although the details of the principle of image forming processes as microscopically viewed in the present embodiment are not clear, the inventors of the present invention presumes as follows.

(1) The ink carrying member 41 is first rotated, to bring the layer of the ink 42 carried on the surface of the ink carrying member 41 near the image carrying member 1, whereby the layer of the ink 42 on the surface of the ink carrying member 41 is brought into contact with a layer of the release agent 32 on the surface of the image carrying member 1.

(2) Charge having a polarity opposite to the polarity of charge on the surface of the image carrying member 1 is induced on the surface of the ink 42 through the layer of the release agent 32 on the image carrying member 1 by the charge on the surface of the image carrying member 1. Therefore, the layer of the ink 42 is drawn toward the image carrying member 1 and is moved in such a manner as to put aside the layer of the release agent 32 upon exertion of an electrostatic attraction force. In this case, only a colorant is not moved, but components of the ink 42 are integrally moved.

(3) When the ink carrying member 41 is separated from the image carrying member 1 so that the spacing therebetween exceeds a predetermined value, an electrostatic force exerted between the layer of the ink 42 in an image portion and the charge on the image carrying member 1 exceeds a cohesive force of the ink 42, so that the layer of the ink 42 is changed into an image upon being cut to predetermined thicknesses and left on the side of the release agent 32.

(4) On the other hand, the layer of the ink 42 in a non-image portion is returned to the ink carrying member 41 without being transferred toward the release agent 32 by the cohesive force of the ink 42 itself.

In a case where the ink 42 carried on the surface of the ink carrying member 41 is brought into contact with the surface of the image carrying member 1 coated with the release agent 32, to form an ink image corresponding to the electrostatic latent image on the surface of the image carrying member 1, the formed image does not have a sufficient image density when the thickness of the layer of the ink 42 carried on the surface of the ink carrying member 41 is too small, while the formed image is liable to be fogged when the thickness of the layer of the ink 42 is too large. Therefore, it is preferable that the thickness of the layer of the ink 42 on the surface of the ink carrying member 41 is in the range of 1 to 50 μm.

The details of the reason why the thickness of the layer of the ink 42 which is brought into contact with the image carrying member 1 having the release agent 32 applied to its surface affects the image formation are not clear. It greatly depends on the cohesive force of the ink 42 itself and an adhesive force between the ink 42 and the release agent 32 whether or not the layer of the ink 42 in the non-image portion is transferred toward the release agent 32 when the layer of the ink 42 which is brought into contact with the release agent 32 once is separated. It is considered that one of principal causes which affect the cohesive force of the ink 42 itself is the thickness of the layer of the ink 42 which is brought into contact with the release agent 42. In a case where the layer of the ink 42 has a suitable thickness, it is considered that when the layer of the ink 42 which is in contact with the release agent 32 once is separated, the electrostatic force exerted between the layer of the ink 42 in the image portion and the charge on the image carrying member 1 exceeds the cohesive force of the ink 42 itself, so that the layer of the ink 42 is changed into an image upon being cut to predetermined thicknesses and left on the side of the release agent 32, while the layer of the ink 42 in the non-image portion is returned to the ink carrying member 41 without being transferred toward the release agent 32 by the cohesive force of the ink 42 itself.

Furthermore, in a case where the ink 42 carried on the ink carrying member 41 is thus brought into contact with the image carrying member 1 to form an ink image corresponding to the electrostatic latent image, when the ink carrying member 41 is brought into contact with the image carrying member 1 so as to be pressed hard thereagainst, the formed image is liable to be fogged. Therefore, it is preferable that the ink carrying member 41 is brought into contact with the image carrying member 1 in a state where no strong pressure is applied thereto.

On the other hand, a paper feeding tray 71 containing paper 7 is provided on an upper side surface of the image forming apparatus 200, and a transfer roller 6 for transferring an ink image on the paper 7 is provided above the image carrying member 1. The paper 7 is fed toward an opposite portion of the image carrying member 1 and the transfer roller 6 by a paper feeding roller 72 from the paper feeding tray 71, and the ink image formed on the surface of the image carrying member 1 in the above-mentioned manner is transferred under pressure onto the paper 7 by the transfer roller 6.

The paper 7 on which the ink image has been transferred is conveyed by a conveying belt 73, and is discharged to a discharge tray 74. The ink 42 remaining on the surface of the image carrying member 1 after the transfer is removed from the surface of the image carrying member 1 by a cleaning device 5, after which the charge on the surface of the image carrying member 1 is eliminated by a discharger 8. Image formation is achieved by repeating the above-mentioned operations.

Description is now made of specific experimental examples of Embodiment 2 in Experimental Examples 2 to 5.

EXPERIMENTAL EXAMPLE 2

In this experimental example, an image carrying member 1 so adapted that a dielectric layer composed of a polyamide resin having a thickness of 20 μm is formed on the surface of a drum made of aluminum is used as the image carrying member 1, while a plurality of stylus discharge electrodes using a copper wire having a diameter of 50 μm are used as the discharge electrode 2 to induce discharges so that an electrostatic latent image having a surface potential of approximately −800 V is formed on the surface of the image carrying member 1. The system speed is set to 40 mm/s.

A silicone oil having a viscosity of approximately 291 cp (Silicone Oil SH 200; manufactured by Toray Dow Coning Silicone Co., Ltd.) is used as the release agent 32, and an ink whose viscosity is set to approximately 150,000 cp by adjusting the viscosity of an ink for planographic printing (BSD New Rubber Base; manufactured by Bunshodo K.K.) using a viscosity adjustor (Ink Refresher; manufactured by Bunshodo K.K.) is used as the ink 42. In the experimental examples subsequent to this experimental example, the viscosity of the ink is measured using an E-type viscosimeter (VISCONIC ED; manufactured by Tokyo Keiki K.K.). The measuring conditions are 3°×R7.7 Cone, 0.5 rpm, and 25° C.

The position of the regulating blade 33 is adjusted, thereby to change the thickness of the silicone oil 32 applied to the surface of the image carrying member 1 in the range of 0.01 to 20 μm, as shown in the following Tables 2 to 4, while the position of an ink regulating blade (not shown) provided in the ink developing device 4 is adjusted, thereby to change the thickness of the ink layer 42 on the ink carrying member 41 to 10 μm, 20 μm and 30 μm, to supply the ink 42 to the surface of the image carrying member 1. The contact pressure between the ink carrying member 41 and the image carrying member 1 is set to a line pressure of 0.3 kg/cm.

Each of ink images thus formed on the surface of the image carrying member 1 is transferred onto the paper 7 by the transfer roller 6 in the above-mentioned manner, to form an image on the paper 7. The contact pressure between the transfer roller 6 and the image carrying member 1 is set to a line pressure of 1 kg/cm.

The image on the paper 7 thus obtained is then evaluated. In evaluating the image, image densities in an image portion and a non-image portion are respectively measured using a reflection densitometer (Sakura Densitometer PDA65), and the difference in image density (contrast) between the image portion and the non-image portion is found. Further, a case where a good image having a contrast of not less than 0.8 and having an image density of less than 0.3 in its non-image portion is obtained is evaluated as ○, a case where an image having a contrast of not less than 0.45 and less than 0.8 and having an image density of less than 0.5 in its non-image portion or an image having a contrast of not less than 0.8 and having an image density of not less than 0.3 and less than 0.5 in its non-image portion, which has no problems in terms of practical applications, is obtained is evaluated as Δ, and a case where an image having a contrast of less than 0.45 or an image having an image density of not less than 0.5 in its non-image portion, which has problems, is obtained is evaluated as x. The results are shown in Table 2 to Table 4.

TABLE 2

| thickness of oil (μm) | thickness of ink (μm) | image density: image portion | image density: non-image portion | contrast | evaluation |
|---|---|---|---|---|---|
| 0.01 | 10 | 2.2 | 2.1 | 0.1 | x |
| 0.1 | 10 | 2.1 | 0.25 | 1.85 | ○ |
| 0.5 | 10 | 2.1 | 0.18 | 1.92 | ○ |
| 1 | 10 | 2.1 | 0.10 | 2.00 | ○ |
| 3 | 10 | 1.8 | 0.05 | 1.75 | ○ |
| 5 | 10 | 1.2 | 0.03 | 1.17 | ○ |
| 8 | 10 | 0.60 | 0.02 | 0.58 | Δ |
| 10 | 10 | 0.47 | 0.02 | 0.45 | Δ |
| 12 | 10 | 0.35 | 0.02 | 0.33 | x |
| 15 | 10 | 0.20 | 0.02 | 0.18 | x |
| 20 | 10 | 0.10 | 0.02 | 0.08 | x |

TABLE 3

| thickness of oil (μm) | thickness of ink (μm) | image density: image portion | image density: non-image portion | contrast | evaluation |
|---|---|---|---|---|---|
| 0.01 | 20 | 2.2 | 2.1 | 0.10 | x |
| 0.1 | 20 | 2.1 | 0.38 | 1.72 | Δ |
| 0.5 | 20 | 2.1 | 0.27 | 1.83 | ○ |
| 1 | 20 | 2.1 | 0.21 | 1.89 | ○ |
| 3 | 20 | 2.0 | 0.09 | 1.91 | ○ |
| 5 | 20 | 1.55 | 0.03 | 1.52 | ○ |
| 8 | 20 | 0.72 | 0.02 | 0.70 | Δ |
| 10 | 20 | 0.55 | 0.02 | 0.53 | Δ |
| 12 | 20 | 0.40 | 0.02 | 0.38 | x |
| 15 | 20 | 0.25 | 0.02 | 0.23 | x |
| 20 | 20 | 0.20 | 0.02 | 0.18 | x |

TABLE 4

| thickness of oil (μm) | thickness of ink (μm) | image density: image portion | image density: non-image portion | contrast | evaluation |
|---|---|---|---|---|---|
| 0.01 | 30 | 2.22 | 2.15 | 0.07 | x |
| 0.1 | 30 | 2.15 | 0.42 | 1.73 | Δ |
| 0.5 | 30 | 2.12 | 0.29 | 1.81 | ○ |
| 1 | 30 | 2.10 | 0.24 | 1.86 | ○ |
| 3 | 30 | 2.05 | 0.11 | 1.94 | ○ |
| 5 | 30 | 1.66 | 0.03 | 1.63 | ○ |
| 8 | 30 | 0.82 | 0.02 | 0.80 | ○ |
| 10 | 30 | 0.58 | 0.02 | 0.56 | Δ |
| 12 | 30 | 0.43 | 0.02 | 0.41 | x |
| 15 | 30 | 0.28 | 0.02 | 0.26 | x |
| 20 | 30 | 0.24 | 0.02 | 0.22 | x |

EXPERIMENTAL EXAMPLE 3

In this experimental example, the same image carrying member and the same discharge electrode as those in Experimental Example 2 are used as the image carrying member 1 and the discharge electrode 2, to form respective electrostatic latent images having surface potentials of approximately −100 V, −150 V, −200 V, −500 V, −1000 V, −2000 V, −2500 V, and −3000 V on the surface of the image carrying member 1. The system speed is set to 40 mm/s.

As the release agent 32, a silicone oil having a viscosity of approximately 291 cp (Silicone Oil SH200; manufactured by Toray Dow Coning Silicone Co., Ltd.) is used. The position of the regulating blade 33 is adjusted, to set the thickness of the silicone oil 32 applied to the surface of the image carrying member 1 to 1 μm in an experiment shown in Table 5, while setting the thickness of the silicone oil 32 applied to the surface of the image carrying member 1 to 5 μm in an experiment shown in Table 6.

Furthermore, an ink whose viscosity is set to approximately 150,000 cp by adjusting the viscosity of an ink for planographic printing (BSD New Rubber Base; manufactured by Bunshodo K.K.) using a viscosity adjustor (Ink Refresher; manufactured by Bunshodo K.K.) is used as the ink 42. The position of an ink regulating blade (not shown) provided in the ink developing device 4 is adjusted, to set the thickness of the ink 42 on the ink carrying member 41 to approximately 10 μm. The contact pressure between the ink carrying member 41 and the image carrying member 1 is set to a line pressure of 0.3 kg/cm.

Each of ink images formed on the surface of the image carrying member 1 is transferred onto the paper 7 by the transfer roller 6, to evaluate a formed image. The contact pressure between the transfer roller 6 and the image carrying member 1 is set to a line pressure of 1 kg/cm.

Figure 3A:
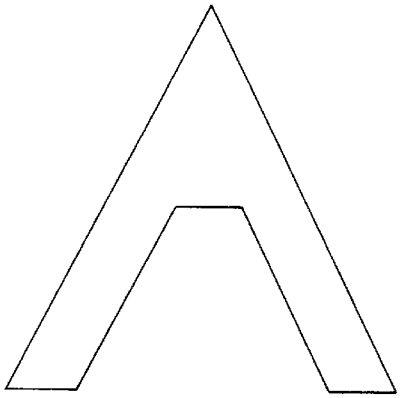
FIGS. 3(A) and 3(B) show an image having no voids and an image having voids, respectively.
Figure 3B:
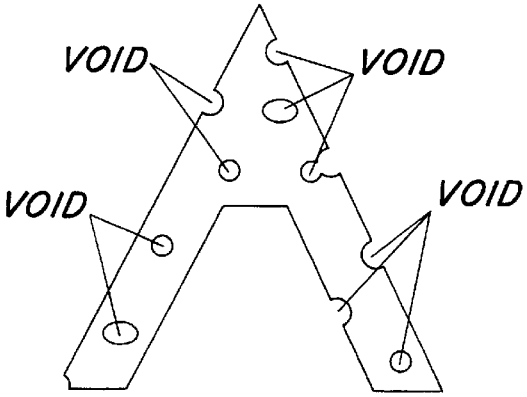

In evaluating the image formed on the paper 7, image densities in an image portion and a non-image portion are respectively measured using a reflection densitometer (Sakura Densitometer PDA65), and the difference in image density (contrast) between the image portion and the non-image portion is found. Further, the presence or absence of voids in the image formed on the paper 7 is examined. A case where an image having no voids as shown in FIG. 3(A) is obtained is evaluated as ○, and a case where an image having voids created therein as shown in FIG. 3(B) is obtained is evaluated as x. Further, a case where a good image having no voids created therein, having a contrast of not less than 0.8 and having an image density of less than 0.3 in its non-image portion is obtained is evaluated as ○, a case where an image having no voids created therein, having a contrast of not less than 0.45 and less than 0.8 and having an image density of less than 0.5 in its non-image portion or an image having a contrast of not less than 0.8 and having an image density of not less than 0.3 and less than 0.5 in its non-image portion, which has no problems in terms of practical applications, is obtained is evaluated as Δ, and a case where an image having voids created therein, having a contrast of less than 0.45 or having an image density of not less than 0.5 in its non-image portion, which has problems, is obtained is evaluated as x. The results are shown in Table 5 and Table 6.

TABLE 5

| conditions thickness of oil 5 μm, thickness of ink 10 μm | | | | | | | | |
|---|---|---|---|---|---|---|---|---|
| surface potential(−V) | 100 | 150 | 200 | 500 | 1000 | 2000 | 2500 | 3000 |
| density in image portion | 0.10 | 0.30 | 0.65 | 2.05 | 2.15 | 2.2 | 2.2 | 2.2 |
| contrast | 0.05 | 0.25 | 0.58 | 1.95 | 2.03 | 2.07 | 2.05 | 2.05 |

TABLE 5-continued

| | conditions thickness of oil 5 μm, thickness of ink 10 μm | | | | | | | |
|---|---|---|---|---|---|---|---|---|
| void | ○ | ○ | ○ | ○ | ○ | ○ | x | x |
| synthetic evaluation | x | x | Δ | ○ | ○ | ○ | x | x |

TABLE 6

| | conditions thickness of oil 5 μm, thickness of ink 10 μm | | | | | | | |
|---|---|---|---|---|---|---|---|---|
| surface potential (−V) | 100 | 150 | 200 | 500 | 1000 | 2000 | 2500 | 3000 |
| density in image portion | 0.08 | 0.20 | 0.55 | 1.23 | 1.86 | 2.11 | 2.15 | 2.15 |
| contrast | 0.07 | 0.18 | 0.53 | 1.20 | 1.82 | 2.07 | 2.08 | 2.06 |
| void | ○ | ○ | ○ | ○ | ○ | ○ | x | x |
| synthetic evaluation | x | x | Δ | ○ | ○ | ○ | x | x |

EXPERIMENTAL EXAMPLE 4

In this experimental example, the same image carrying member and the same discharge electrode as those in the Experimental Example 2 are used as the image carrying member 1 and the discharge electrode 2, to form an electrostatic latent image having a surface potential of approximately −800 V on the surface of the image carrying member 1. The system speed is set to 40 mm/s.

A silicone oil having a viscosity of approximately 291 cp (Silicone Oil SH200; manufactured by Toray Dow Coning Silicone Co., Ltd.) is used as the release agent 32. The position of the regulating blade 33 is adjusted, thereby to set the thickness of the silicone oil 32 applied to the surface of the image carrying member 1 to approximately 0.1 μm in an experiment shown in the following Table 7, approximately 1 μm in an experiment shown in the following Table 8, and approximately 5 μm in an experiment shown in the following Table 9.

Furthermore, an ink whose viscosity is set to approximately 150,000 cp by adjusting the viscosity of an ink for planographic printing (BSD New Rubber Base; manufactured by Bunshodo K.K.) using a viscosity adjustor (Ink Refresher; manufactured by Bunshodo K.K.) is used as the ink 42. The position of an ink regulating blade (not shown) provided in the ink developing device 4, which is ink developing means, is adjusted, thereby to change the thickness of the ink 42 on the ink carrying member 41 in the range of approximately 0.1 to 100 μm as shown in the following Tables 7 to 9, so that ink images are formed on the surface of the image carrying member 1 upon respectively supplying the ink 42 to the surface of the image carrying member 1 coated with the silicone oil 32 from the ink carrying member 41 as described above. The contact pressure between the ink carrying member 41 and the image carrying member 1 is set to a line pressure of 0.3 kg/cm.

Each of the ink images formed on the surface of the image carrying member 1 is transferred onto the paper 7 by the transfer roller 6, to evaluate a formed image. The contact pressure between the transfer roller 6 and the image carrying member 1 is set to a line pressure of 1 kg/cm.

In evaluating the image formed on the paper 7, image densities in an image portion and a non-image portion are respectively measured using a reflection densitometer (Sakura Densitometer PDA65), and the difference in image density (contrast) between the image portion and the non-image portion is found. Further, the synthetic evaluation is carried out by the same standard as that in Experimental Example 1. The results are shown in Table 7 to Table 9.

TABLE 7

| | thickness of applied silicone oil 0.1 μm | | | | | | | |
|---|---|---|---|---|---|---|---|---|
| | thickness of ink (μm) | | | | | | | |
| | 0.1 | 1 | 10 | 20 | 40 | 50 | 60 | 100 |
| density in image portion | 0.25 | 0.87 | 2.17 | 2.20 | 2.23 | 2.30 | 2.30 | 2.30 |
| density in non-image portion | 0.13 | 0.15 | 0.25 | 0.38 | 0.42 | 0.47 | 1.10 | 1.85 |
| contrast | 0.12 | 0.72 | 1.92 | 1.82 | 1.81 | 1.83 | 1.20 | 0.45 |
| synthetic evaluation | x | Δ | ○ | Δ | Δ | Δ | x | x |

TABLE 8

| | thickness of applied silicone oil 1 μm | | | | | | | |
|---|---|---|---|---|---|---|---|---|
| | thickness of ink (μm) | | | | | | | |
| | 0.1 | 1 | 10 | 20 | 40 | 50 | 60 | 100 |
| density in image potion | 0.10 | 0.75 | 2.12 | 2.15 | 2.15 | 2.17 | 2.20 | 2.20 |
| density in non-image portion | 0.02 | 0.03 | 0.10 | 0.12 | 0.20 | 0.35 | 0.75 | 1.58 |
| contrast | 0.08 | 0.72 | 2.02 | 2.03 | 1.95 | 1.82 | 1.45 | 0.62 |
| synthetic evaluation | x | Δ | ○ | ○ | ○ | Δ | x | x |

TABLE 9

| | thickness of applied silicone oil 5 μm | | | | | | | |
|---|---|---|---|---|---|---|---|---|
| | thickness of ink (μm) | | | | | | | |
| | 0.1 | 1 | 10 | 20 | 40 | 50 | 60 | 100 |
| density in image portion | 0.05 | 0.50 | 1.20 | 1.55 | 1.65 | 1.70 | 1.74 | 1.78 |
| density in non-image portion | 0.02 | 0.02 | 0.03 | 0.03 | 0.14 | 0.22 | 0.56 | 1.12 |
| contrast | 0.03 | 0.48 | 1.17 | 1.52 | 1.51 | 1.48 | 1.18 | 0.06 |
| synthetic evaluation | x | Δ | ○ | ○ | ○ | ○ | x | x |

EXPERIMENTAL EXAMPLE 5

In this experimental example, the same image carrying member and the same discharge electrode as those in Experimental Example 2 are used as the image carrying member 1 and the discharge electrode 2, to form an electrostatic latent image having a surface potential of approximately −800 V on the surface of the image carrying member 1. The system speed is set to 40 mm/s.

A silicone oil having a viscosity of approximately 291 cp (Silicone Oil SH200; manufactured by Toray Dow Coning Silicone Co., Ltd.) is used as the release agent 32. The position of the oil regulating blade 33 is adjusted, thereby to apply the silicone oil 32 on the surface of the image carrying member 1 having the electrostatic latent image formed thereon so that the thickness thereof is approximately 10 μm.

Furthermore, five types of inks which differ in volume resistivity shown in the following Table 10 are used as the ink 42. In addition, the position of an ink regulating blade (not shown) provided in the ink developing device 4, which is ink developing means, is adjusted, thereby to set the respective thicknesses of the inks 42 on the ink carrying member 41 to 10 μm, so that ink images are formed on the surface of the image carrying member 1 upon respectively bringing the inks 42 carried on the ink carrying member 41 into contact with the surface of the image carrying member 1 coated with the silicone oil 32.

The contact pressure between the ink carrying member 41 and the image carrying member 1 is set to a line pressure of 0.3 kg/cm, and the contact pressure between the transfer roller 6 and the image carrying member 1 is set to a line pressure of 1 kg/cm. In Table 10, inks 3, 4 and 5 are ones whose viscosities are adjusted using a viscosity adjustor, and inks 1 and 2 are used as they are. As the viscosity adjustor, Dai Cure R Reducer (manufactured by Dainippon Ink & Chemicals, Inc.), Ink Refresher (manufactured by Bunshodo K.K.), and HIZ Reducer (manufactured by Dainippon Ink & Chemicals, Inc.) are respectively used for the inks 3, 4 and 5.

TABLE 10

| type | name |
|---|---|
| ink 1 | FCUP (Gravure Ink; manufactured by Toyo Ink Mfg. Co., Ltd.) |
| ink 2 | OG (Gravure Ink; manufactured by Toyo Ink Mfg. Co., Ltd.) |
| ink 3 | Dycure Scepter Process India Ink N (UV Photographic Ink; manufactured by Dainippon Ink & Chemicals, Inc.) |

TABLE 10-continued

| type | name |
|---|---|
| ink 4 | BSD New Rubber Base (planographic Ink; manufactured by Bunshodo K.K.) |
| ink 5 | Dry-O-color 95 F India Ink N (Water-less Planographic Ink; manufactured by Dainippon Ink & Chemicals, Inc.) |

The volume resistivity values of the foregoing five types of inks are then measured by the following procedure. The results thereof are shown in the following Table 11.

(1) A sample is put in a 3 ml pipette, and is set on an electrode for liquid measurement (LE-22; manufactured by Ando Denki K.K.) having a first electrode in a cylindrical shape and a second electrode provided with a recess having a slightly larger bore diameter than the diameter of the first electrode. In the case, the distance between the first electrode and the second electrode is set to 0.15 cm (=L). Consequently, the surface area of the ink in contact with the electrode is calculated (=S).

(2) A voltage (V=300 V) is applied between the first and second electrodes.

(3) A measuring switch of an ammeter connected in series with the above-mentioned electrode for liquid measurement on an equivalent circuit is turned on, to read its current value (=I).

(4) A volume resistivity ρ (Ω.cm) is calculated by the following equation:

$$\rho=(V/I)\cdot(S/L)$$

An ink image is formed on the surface of the image carrying member 1 using each of the above-mentioned inks, and an image obtained by transferring the ink image onto the paper 7 is evaluated. In evaluating the image, image densities in an image portion and a non-image portion are measured using a reflection densitometer (Sakura Densitometer PDA65). Further, the difference in image density (contrast) between the image portion and the non-image portion is found, to carry out the synthetic evaluation by the same standard as that in Experimental Example 1.

TABLE 11

| type of ink (μm) | volume resistivity of ink (Ω · cm) | density in image portion | density in non-image portion | synthetic evaluation |
|---|---|---|---|---|
| ink 1 | $3.2 \times 10^5$ | 2.02 | 2.02 | x |
| ink 2 | $7.6 \times 10^7$ | 2.25 | 2.25 | x |
| ink 3 | $1.9 \times 10^9$ | 2.02 | 0.45 | Δ |
| ink 4 | $2.3 \times 10^{11}$ | 2.17 | 0.25 | ○ |
| ink 5 | $1.0 \times 10^{12}$ | 1.55 | 0.22 | ○ |

EMBODIMENT 3

Figure 4:
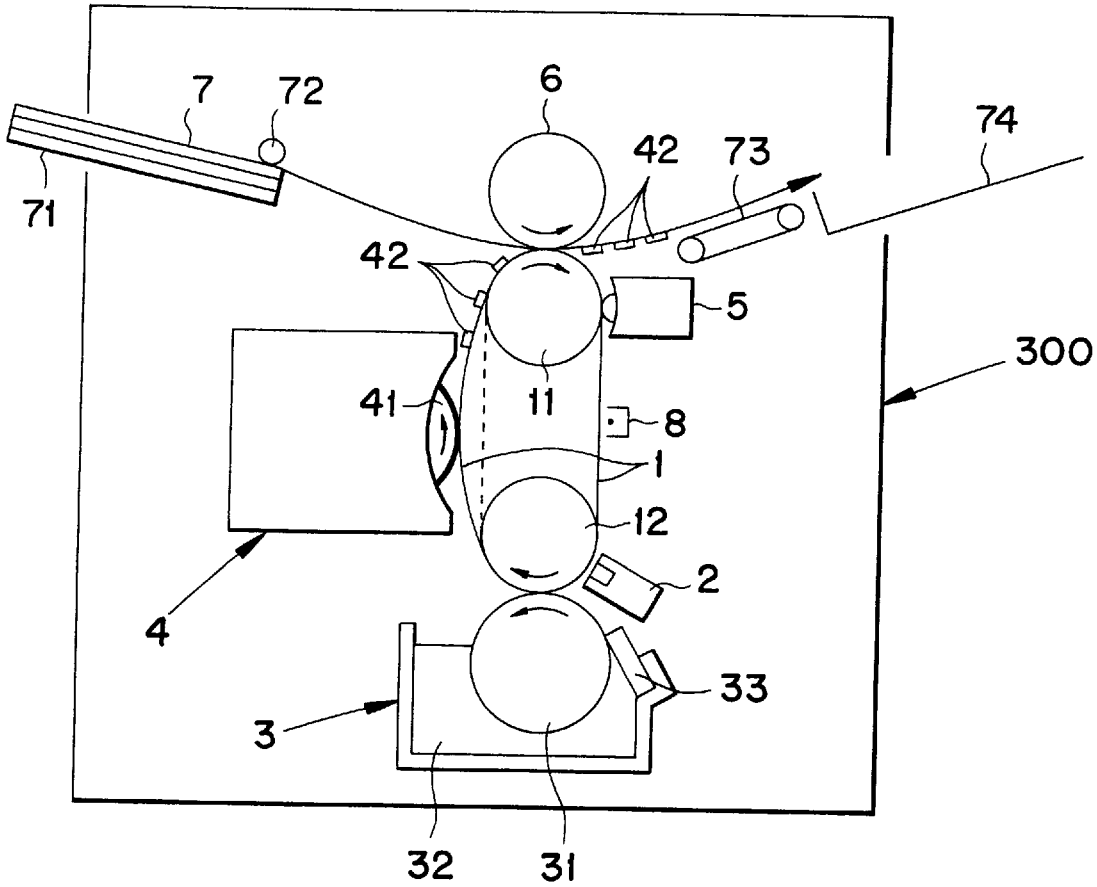
FIG. 4 is a schematic view showing an image forming apparatus according to another embodiment of the present invention.

FIG. 4 is a schematic cross-sectional view showing an image forming apparatus 300 according to another embodiment of the present invention. As shown in FIG. 4, an image forming apparatus 300 uses a flexible image carrying member 1. The other construction is approximately the same as that described in FIG. 2 and hence, the detailed description thereof is omitted.

The flexible image carrying member 1 is not particularly limited, provided that it is so adapted that a dielectric layer is formed on an electrically conductive member and has flexibility. It is possible to use image carrying members in various forms. The shape thereof is not particularly limited. For example, the shape may be a thin sleeve shape or a film shape.

In the image forming apparatus 300, the image carrying member 1 formed in an endless belt shape is stretched between a holding roller 11 and a driving roller 12 which are provided with predetermined spacing, and the image carrying member 1 is driven by the driving roller 12.

The peripheral length of the image carrying member 1 in an endless belt shape is made larger than the peripheral length of a moving path which is constituted by the holding roller 11 and the driving roller 12, and a portion, which faces an ink developing device 4, of the image carrying member 1 is projected toward the ink developing device 4. The image carrying member 1 is driven by the driving roller 12 in a state where it is in soft contact with the surface of an ink carrying member 41 provided in the ink developing device 4.

Specific examples of preferred image forming conditions in the present embodiment will be described. An image carrying member formed in an endless belt shape upon depositing aluminum to a thickness of approximately 0.5 $\mu$m on the reverse surface of a dielectric film composed of a polyethylene terephtalate resin having a thickness of 25 $\mu$m is used as the image carrying member 1.

As a discharge electrode 2, the same one as that described in Experimental Example 2 is used. A voltage having a negative polarity is applied to the discharge electrode 2 to induce discharges, to form an electrostatic latent image having a surface potential of approximately −1 kV on the surface of the image carrying member 1. The system speed is set to 40 mm/s.

A silicone oil having a viscosity of 291 cp (Silicone Oil SH200; manufactured by Toray Dow Coning Silicone Co., Ltd.) is used as a release agent 32, and is applied to the surface of the image carrying member 1 having the electrostatic latent image formed thereon so that the thickness thereof is approximately 1 $\mu$m.

An ink whose viscosity is set to approximately 150,000 cp by adjusting an ink for planographic printing (BSD New Rubber Base; manufactured by Bunshodo K.K.) using a viscosity adjustor (Ink Refresher; manufactured by Bunshodo K.K.) is used as the ink 42. The thickness of the ink 42 carried on the surface of the image carrying member 41 is adjusted to approximately 10 $\mu$m.

The contact pressure between the transfer roller 6 and the image carrying member 1 is set to a line pressure of 0.3 kg/cm.

When the surface of the image carrying member 1 is brought into contact with the ink 42 carried on the ink carrying member 41 in the portion, which is projected toward the ink developing means 4, of the image carrying member 1 as described above, the surface of the image carrying member 1 is softly and reliably brought into contact with the ink 42 carried on the ink carrying member 41. Therefore, the ink 42 hardly adheres to a portion where no electrostatic latent image is formed of the image carrying member 1, while the ink 42 in sufficient quantity is supplied to a portion where the electrostatic latent image is formed. As a result, when an ink image formed on the surface of the image carrying member 1 is transferred onto paper 7 to form an image, the image formed on the paper 7 is a good image which is hardly fogged and has a sufficient image density.

EMBODIMENT 4

Figure 5:
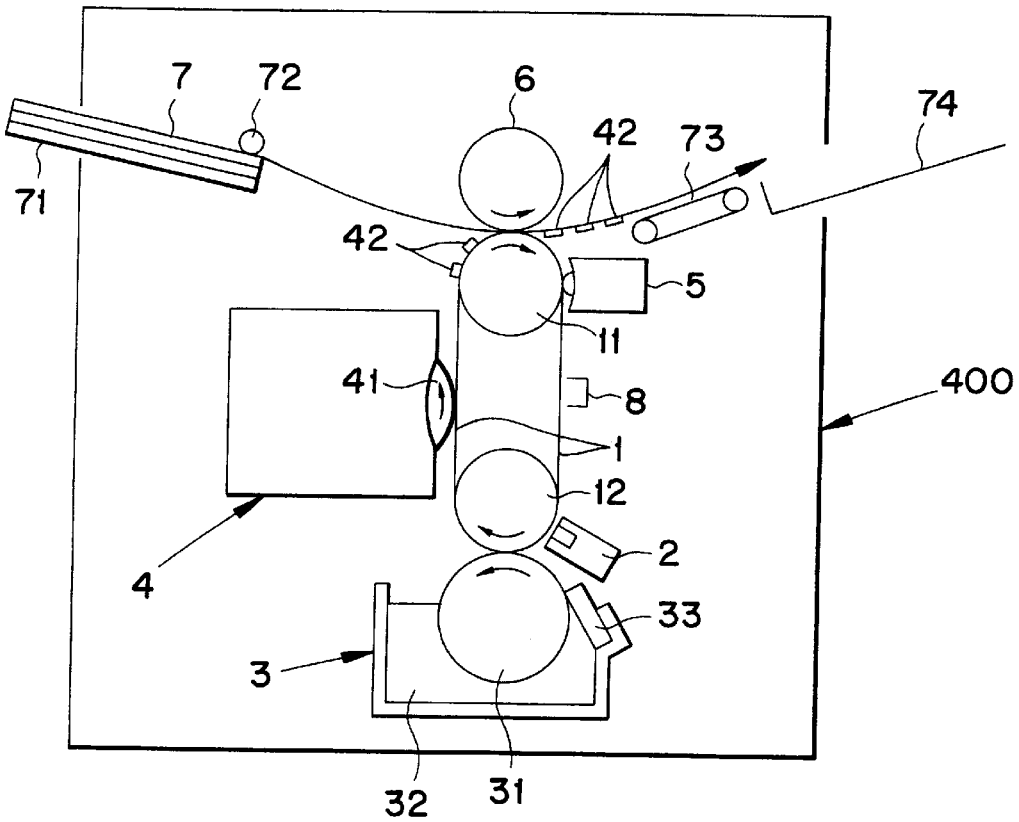
FIG. 5 is a schematic view showing an image forming apparatus according to still another embodiment of the present invention.

FIG. 5 is a schematic cross-sectional view showing an image forming apparatus 400 according to one embodiment of the present invention. As shown in FIG. 5, the image forming apparatus 400 differs from the image forming apparatus described in EMBODIMENT 3. The peripheral length of an image carrying member 1 in an endless belt shape is made approximately equal to the peripheral length of a moving path constituted by a holding roller 11 and a driving roller 12. Consequently, the image carrying member 1 stretched between the holding roller 11 and the driving roller 12 is not projected toward an ink developing device 4. The other construction is the same as that of the image forming apparatus in EMBODIMENT 3.

Also in the image forming apparatus 400, an ink 42 carried on an ink carrying member 41 is brought into soft contact with the surface of the image carrying member 1. As in the case of EMBODIMENT 3, therefore, the ink 42 hardly adheres to a portion where no electrostatic latent image is formed of the image carrying member 1, while the ink 42 in sufficient quantity is supplied to a portion where the electrostatic latent image is formed. Therefore, an image formed on recording medium such as paper 7 is a good image which is hardly fogged and has a sufficient image density.

Various advantages are obtained by forming an image using the ink 42 described in each of the above-mentioned embodiments.

First, only a colorant is not selectively consumed, but the ink 42 is consumed as a whole in forming an image. Therefore, it is not particularly necessary that the density of the ink 42 is managed as the image is formed. Further, the possibility that the ink 42 is degraded is low.

Furthermore, an ink image transferred onto the recording medium 7 is naturally dried mainly by penetration into the recording medium 7 and oxidation, evaporation and the like in air, whereby the fixing process on the recording medium 7 is not particularly required.

In addition thereto, when an image is formed using the ink 42 as in each of the above-mentioned embodiments, there are advantages in terms of various points, for example, improvement of resolution, prevention of odors, safety of an environment, and productivity at relatively low cost.

A liquid developer used in an electrophotographic device of a liquid development type is generally constructed by dispersing charged colored resin fine particles (toner particles) in an insulating carrier liquid. Since the toner particles are selectively consumed from components of the liquid developer as an image is formed, the density of toner in the carrier liquid must be managed when the liquid developer is used. Further, much of the carrier liquid is repeatedly used, whereby the liquid developer is liable to be degraded.

Furthermore, in the electrophotographic device of a liquid development type, when an image is formed on a recording medium such as copy paper, a toner image transferred onto the recording medium must be fixed by a thermal fixing roller or the like.

In each of the above-mentioned embodiments, an image is formed mainly using an ink, whereby the density of the ink need not be managed, which is advantageous in terms of maintenance of the image quality and simplicity of maintenance in repeating image formation.

Furthermore, a relatively high-cost photoreceptor which is easily degraded or deteriorated is not used as the image carrying member 1, whereby a stable image can be obtained over a long time period, which is advantageous in terms of cost.

Additionally, all an exposing device, a fixing device, a developer density adjusting device and the like which are provided in the conventional electrophotographic device of a liquid development type are not required, whereby the construction of the image forming apparatus is significantly simplified as a whole, which is advantageous in terms of weight reduction, cost reduction, size reduction, and the like.

Although the present invention has been fully described by way of examples with reference to the accompanying drawings, it is to be noted that various changes and modifications will be apparent to those skilled in the art.

Therefore, unless otherwise such changes and modifications depart from the scope of the present invention, they should be constructed as being included therein.

What is claimed is:

1. An image forming method comprising the steps of:

forming an electrostatic latent image on an image carrying member;

applying a release agent to the image carrying member on which the electrostatic latent image is formed; and providing a toner-free ink to the image carrying member coated with the release agent in order to form an ink image corresponding to the electrostatic latent image, said ink having a high volume resistivity of not less than $1\times10^{8}\Omega\cdot$cm.

2. The method according to claim 1, wherein the electrostatic latent image is formed before applying the release agent.

3. The method according to claim 1, wherein the electrostatic latent image is formed after applying the release agent.

4. The method according to claim 1, wherein said release agent comprises a silicone oil.

5. The method according to claim 1, wherein a layer of the release agent formed on the image carrying member has a thickness of 0.1 to 10 $\mu$m.

6. The method according to claim 1, wherein said ink has a viscosity in the range of 10,000 to 1,000,000 cp.

7. The method according to claim 1, wherein said ink comprises a colorant and a vehicle.

8. An image forming apparatus, comprising:

an image carrying member;

a latent image forming device for forming an electrostatic latent image on the image carrying member;

an application device for applying a release agent to the image carrying member on which the electrostatic latent image is formed; and an ink provider for providing a toner-free ink to the image carrying member coated with the release agent in order to form an ink image corresponding to the electrostatic latent image, said ink having a high volume resistivity of not less than $1\times10^{8}\Omega\cdot$cm.

9. The apparatus according to claim 8, wherein a layer of the release agent formed on the image carrying member has a thickness of 0.1 to 10 $\mu$m.

10. The apparatus according to claim 8, wherein the absolute value of the surface potential of the electrostatic latent image is in the range of 200 to 2,000 V.

11. The apparatus according to claim 8, wherein said ink provider comprises an ink carrying member which has an ink layer carried on its surface.

12. The apparatus according to claim 11, wherein said ink layer carried on the ink carrying member has a thickness in the range of 1 to 50 $\mu$m.

13. The apparatus according to claim 11, wherein said image carrying member is made of a flexible material.

14. The apparatus according to claim 13, wherein said image carrying member has a bend portion which faces the ink carrying member and is projected toward the ink carrying member.

15. The apparatus according to claim 8, wherein said ink has the volume resistivity of from $1\times10^{8}\Omega\cdot$cm to $1\times10^{16}\Omega\cdot$cm.

16. The apparatus according to claim 8, wherein said ink has a viscosity in the range of 10,000 to 1,000,000 cp.

17. The apparatus according to claim 8, wherein said ink comprises a colorant and a vehicle.

18. The apparatus according to claim 8, wherein said latent image forming device has a plurality of stylus electrodes.

19. The apparatus according to claim 8, wherein said image carrying member comprises an electrically conductive layer and a dielectric layer formed thereon.

20. The apparatus according to claim 8, wherein said release agent comprises a silicone oil.

21. The apparatus according to claim 8, further comprising an image transfer device for transferring the ink image formed on the image carrying member to a recording medium.

22. An image forming apparatus comprising:

an image carrying member comprising an electrically conductive layer and a dielectric layer formed thereon;

a plurality of stylus electrodes for forming an electrostatic latent image on the image carrying member;

an application device for applying a release agent to the image carrying member on which the electrostatic latent image is formed;

an ink carrying member which has a toner-free ink layer carried on its surface and provides the ink to the image carrying member coated with the release agent in order to form an ink image corresponding to the electrostatic latent image, said ink having a high volume resistivity of not less than $1\times10^{8}\Omega\cdot$cm; and an image transfer device for transferring the ink image formed on the image carrying member to a recording medium.

23. The apparatus according to claim 22, wherein said application device comprises an application roller which is provided opposite to the image carrying member.

24. The apparatus according to claim 22, wherein said ink carrying member comprises a developing roller which is provided opposite to the image carrying member.

* * * * *